US006022425A

United States Patent [19]

Nelson et al.

[11] Patent Number: 6,022,425

[45] Date of Patent: Feb. 8, 2000

[54] CONVERSION COATING AND PROCESS AND SOLUTION FOR ITS FORMATION

[75] Inventors: Karen Joy Hammon Nelson, Clayton; Russell James Taylor, Balwyn; Anthony Ewart Hughes, Olinda; Bruce Roy William Hinton, Frankston; Mark Julian Henderson, Glenhuntly; Lance Wilson, East Bentleigh; Sally Ann Nugent, Surrey Hills, all of Australia

[73] Assignee: Commonwealth Scientific and Industrial Research Organisation, Campbell, Australia

[21] Appl. No.: 08/750,784

[22] PCT Filed: Jun. 9, 1995

[86] PCT No.: PCT/AU95/00340

§ 371 Date: Apr. 7, 1997

§ 102(e) Date: Apr. 7, 1997

[87] PCT Pub. No.: WO95/34693

PCT Pub. Date: Dec. 21, 1995

[30] Foreign Application Priority Data

Jun. 10, 1994 [AU] Australia ..... PM6211

[51] Int. Cl.[7] ..... C23C 22/82

[52] U.S. Cl. ..... 148/272; 148/273; 148/275; 148/276; 148/277; 148/285; 428/472.2

[58] Field of Search ..... 148/270, 272, 148/273, 275, 276, 277, 283, 285; 106/14.21; 428/472.2

[56] References Cited

U.S. PATENT DOCUMENTS

| | | | |
|---|---|---|---|
| 3,969,152 | 7/1976 | Melotik | 148/252 |
| 4,264,278 | 4/1981 | Weingart | 416/226 |
| 4,298,404 | 11/1981 | Greene | 148/6.14 |
| 4,310,390 | 1/1982 | Bradley et al. | 204/37 R |
| 4,349,392 | 9/1982 | Huvar | 148/6.2 |
| 4,359,347 | 11/1982 | Da Fonte, Jr. | 148/273 |
| 4,725,375 | 2/1988 | Fuji et al. | 252/79.4 |

(List continued on next page.)

FOREIGN PATENT DOCUMENTS

| | | |
|---|---|---|
| WO9508008 | of 0000 | Australia . |
| 22855/92 | 9/1992 | Australia . |
| 0 127 572 A2 | 12/1984 | European Pat. Off. . |
| 0 331 284 | 9/1989 | European Pat. Off. . |
| 0 367 504 | 5/1990 | European Pat. Off. . |
| 0 488 430A2 | 3/1992 | European Pat. Off. . |
| 95 92 1651 | 7/1992 | European Pat. Off. . |
| 0603 921 A1 | 6/1994 | European Pat. Off. . |
| 0603 921 B1 | 6/1994 | European Pat. Off. . |

(List continued on next page.)

OTHER PUBLICATIONS

D.R. Arnott, N.E. Ryan, B.R.W. Hinton, B.A. Sexton and A.E. Hughes, "Auger and XPS Studies of Cerium Corrosion Inhibition on 7075 Aluminium Alloy", Applications of Surface Science 22/23 (1985) 235–251, North–Holland, Amsterdam; Elsevier Science Publishers B.V. (North–Holland Physics Publishing Division).

R.G. King, "*Surface Treatment and Finishing of Aluminum*", Chapter 6, Pergamon Press, 1988.

(List continued on next page.)

*Primary Examiner*—Prince Willis
*Assistant Examiner*—Andrew L. Ohmans
*Attorney, Agent, or Firm*—McDermott, Will & Emery

[57] ABSTRACT

A process for forming a conversion coating on the surface of a metal, including: contacting the metal with an acidic solution containing an oxidant in order to initiate growth of a metal oxide cell structure on the metal surface; contacting the metal with water for a period of time sufficient to thicken the oxide and form a metal oxide containing layer of a desired thickness; and treating the metal with one or more rare earth elements in order to impregnate and substantially seal the metal oxide.

45 Claims, 3 Drawing Sheets

U.S. PATENT DOCUMENTS

| | | | |
|---|---|---|---|
| 4,755,224 | 7/1988 | Bibber | 106/14.21 |
| 4,851,148 | 7/1989 | Yamasoe et al. | 252/142 |
| 4,878,963 | 11/1989 | Bibber | 148/262 |
| 4,883,541 | 11/1989 | Tadros | 134/3 |
| 4,921,552 | 5/1990 | Sander et al. | 148/247 |
| 4,988,396 | 1/1991 | Bibber | 148/269 |
| 5,030,323 | 7/1991 | Awad | 156/665 |
| 5,118,138 | 6/1992 | Mansfeld et al. | 205/183 |
| 5,118,356 | 6/1992 | Darmon et al. | 134/3 |
| 5,192,374 | 3/1993 | Kindler | 148/273 |
| 5,194,138 | 3/1993 | Mansfield et al. | 148/273 |
| 5,198,141 | 3/1993 | Darmon et al. | 252/142 |
| 5,221,371 | 6/1993 | Miller | 148/273 |
| 5,356,492 | 10/1994 | Miller | 148/273 |
| 5,356,942 | 10/1994 | Savoca et al. | 521/103 |
| 5,362,335 | 11/1994 | Rungta | 148/275 |
| 5,383,982 | 1/1995 | Hauffe et al. | 148/262 |

FOREIGN PATENT DOCUMENTS

| | | |
|---|---|---|
| 1368230 | 7/1972 | United Kingdom . |
| 2 059 445 | 4/1981 | United Kingdom . |
| 2 097 024 | 10/1982 | United Kingdom . |
| 88/06639 | 9/1988 | WIPO . |
| 95/00340 | 10/1994 | WIPO . |
| WO95/08008 | 3/1995 | WIPO . |
| WO 96/11290A | 4/1996 | WIPO . |
| WO96/11290 | 4/1996 | WIPO . |

OTHER PUBLICATIONS

Abstract—Bibber, J.W., "Corrosion resistant coating composition for aluminum and its alloys—contains alkali metal permanganate and has basic pH".

Abstract—Bibber, J.W., "Corrosion resistant vonversion coating prepn. for aluminum alloys—by typically treating alloy with aluminum and alkai metal nitrate compsn. then alkai metal permanganate compsn.".

Abstract—Bibber, J.W., "Non Toxic corrosion resistant coating for aluminum and alloys—applied from a soln. contg. alkali metal permanganate".

Abstract—Bibber, J.W., "Corrosion resistant coating composition for aluminum alloys—which comprises potassium permanganate and borax, etc. in aq. soln.".

CONVERSION COATING AND PROCESS AND SOLUTION FOR ITS FORMATION

FIELD OF THE INVENTION

This invention relates to a conversion coating for metal surfaces and a process and a solution for forming a conversion coating on metal surfaces. The invention is particularly concerned with a conversion coating on aluminium or aluminium alloy and a process and a solution for the formation of a conversion coating on aluminium or aluminium alloy.

BACKGROUND OF THE INVENTION

The term "conversion coating" is a well known term of the art and refers to the replacement of native oxide on the surface of a metal by the controlled chemical formation of a film. Oxides or phosphates are common conversion coatings. Conversion coatings are used on metals such as aluminium, steel, zinc, cadmium or magnesium and their alloys, and provide a key for paint adhesion and/or corrosion protection of the substrate metal. Accordingly, conversion coatings find application in such areas as the aerospace, automotive, architectural, can stock, instrument and building industries.

Known methods for applying conversion coatings to metal surfaces include treatment with chromate or phosphate solutions, or mixtures thereof. However, in recent years it has been recognised that the hexavalent chromium ion, $Cr^{6+}$, is a serious environmental and health hazard. Similarly, phosphate ions are a serious risk, particularly when they find their way into natural waterways and cause algal blooms. Consequently, strict restrictions have been placed on the quantity of these species used in a number of industrial processes and limitations have been placed on their release to the environment. This leads to costly effluent processing.

In the search for alternative, less toxic conversion coatings, research has been conducted on conversion coatings based on rare earth compounds. However, there is considerable room for improvement in the adhesion and corrosion protection properties of prior rare earth element based conversion coatings and in the time required to deposit those coatings.

Accordingly, it is an object of the present invention to provide a conversion coating for a metal surface and a process for forming a conversion coating on a metal surface which overcome, or at least alleviate, one or more of the disadvantages or deficiencies of the prior art. It is also an object of the present invention to provide an aqueous, rare earth element containing solution for use in providing a conversion coating on a metal surface.

SUMMARY OF THE INVENTION

According to the present invention, there is provided a process for forming a conversion coating on the surface of a metal, including:

- contacting the metal with an acidic solution containing an oxidant in order to initiate growth of a metal oxide cell structure on the metal surface;
- contacting the metal with water for a period of time sufficient to thicken the oxide and form an oxide containing layer of a desired thickness; and
- treating the metal with rare earth elements in order to impregnate and substantially seal the oxide containing layer.

The present invention also provides a conversion coated metal, wherein the conversion coating comprises a metal oxide containing layer which is impregnated with one or more rare earth elements.

The present invention further provides an aqueous, rare earth element containing solution for use in providing a conversion coating on a metal, said solution including a sufficient quantity of a rare earth element to impregnate and substantially seal a metal oxide containing layer formed on the surface of said metal.

The invention will now be described with particular reference to its use for aluminium or aluminium containing alloys. However, a skilled addressee will understand that the invention is not limited to this use and can be used in relation to other metals, such as zinc.

It may be appropriate for the process of the present invention to be preceded by the steps of degreasing and/or cleaning and deoxidising/desmutting the metal surface.

The degreasing step, if present, comprises treatment of the metal surface with any suitable degreasing solution to remove any oils or grease (such as lanoline) or plastic coating present on the metal surface.

The degreasing step, if present, preferably comprises treating the metal surface with a vapour degreasing agent such as trichloroethane or an aqueous degreasing solution available under the trade name of BRULIN. A degreasing step may be necessary, for example, where the metal has been previously coated with lanoline or other oils or grease or with a plastic coating.

Subsequent to the degreasing step, the metal surface preferably undergoes a cleaning step in order to dissolve contaminants and impurities, such as oxides, from the surface of the metal. Preferably, the cleaning step comprises treatment with an alkaline based solution.

The alkaline solution is preferably a "non-etch" solution, that is, one for which the rate of etching of material from the metal surface is low. A suitable alkaline cleaning solution is that commercially available under the trade name RIDOLINE 53.

The treatment with an alkaline cleaning solution is preferably conducted at an elevated temperature, such as up to 80° C., preferably up to 70° C.

Treatment with an alkaline solution often leaves a "smut" on the surface of the metal. As used herein, "smut" is intended to include impurities, oxides and any loosely-bound intermetallic particles which as a result of the alkaline treatment are no longer incorporated into the matrix of the aluminium alloy. It is therefore preferable to treat the metal surface with a "desmutting" or "deoxidizing" solution in order to remove the smut from the metal surface. (Throughout this specification, the terms "desmutting" and "deoxidizing" are used interchangeably). Removal of smut is normally effected by treatment with a desmutting (deoxidizing) solution comprising an acidic solution having effective amounts of appropriate additives. Preferably the desmutting solution also dissolves native oxide from the surface of the metal to leave a homogeneously thin oxide on the metal surface. The desmutting solution may be chromate-based, which due to the presence of $Cr^{6+}$ ions, presents environmental and health risks.

Alternatively the desmutting solution may be one which contains rare earth elements such as the desmutting solution disclosed in co-pending PCT Patent Application No. WO 95/08008, the entire disclosure of which is incorporated herein by reference. Treatment with rare earth containing desmutting solutions lessens the risk to the environment and health and results in improvement in coating time and corrosion performance of subsequently applied conversion coatings. The rare earth element of the desmutting solution preferably should possess more than one higher valence state. By "higher valence state" is meant a valence state above zero valency. Without wishing to be limited to one particular mechanism of smut removal, it is believed that the multiple valence states of the rare earth element imparts a redox function enabling the rare earth element to oxidise surface impurities and result in their removal as ions into solution. Such rare earth elements include cerium, praseodymium, neodymium, samarium, europium, terbium and ytterbium. The preferred rare earth elements are cerium and/or praseodymium and/or a mixture of rare earth elements. Preferably, the rare earth compound is cerium (IV) hydroxide, cerium (IV) sulphate, or ammonium cerium (IV) sulphate. The mineral acid is preferably a mixture of sulphuric acid and nitric acid with $F^-$ ions.

The pH of the rare earth containing desmutting solution is preferably less than 1.

In one embodiment of the invention, the desmutting solution is combined with the acidic, oxidant containing solution used in the process of the present invention to give a single solution which acts both to desmut and to initiate growth of aluminium oxide on the metal surface.

In another embodiment of the present invention, there is provided a process for forming a conversion coating on the surface of a metal including the steps of:

(a) contacting the metal with an acidic solution containing an oxidant in order to initiate growth of a metal oxide cell structure on the metal surface;

(b) contacting the metal with water for a period of time sufficient to thicken the oxide and form an oxide containing layer of a desired thickness;

(c) contacting the metal with an aqueous, rare earth element containing solution in order to impregnate and substantially seal the oxide containing layer.

While the rare earth impregnated aluminium oxide layer formed by the process of the invention has good corrosion properties and provides a good base for any subsequently applied coatings, such as paint, it is preferred that the process of the invention includes a further step comprising treatment with a sealing solution. The rare earth impregnated coating may be sealed by treatment with one of a variety of aqueous or non-aqueous inorganic, organic or mixed organic/inorganic sealing solutions. The sealing solution initially penetrates the semi-porous structure then subsequently forms a surface layer on the rare earth containing coating and may further enhance the corrosion resistance of the rare earth containing coating. Preferably the coating is sealed by an alkali metal silicate solution, such as a potassium silicate solution. Examples of potassium silicate solutions which may be used are those commercially available under the trade names "PQ Kasil #2236" and "PQ Kasil #1". Alternatively, the alkali metal sealing solution may be sodium based, such as a sodium silicate or a sodium orthophosphate, or a mixture thereof.

Preferably, each step of the process of the present invention is followed by a water rinsing step.

DESCRIPTION OF DRAWINGS

The invention will become more readily apparent from the following exemplary description in connection with the accompanying drawings and Examples.

DETAILED DESCRIPTION OF THE PREFERRED EMBODIMENTS

Figure 1:
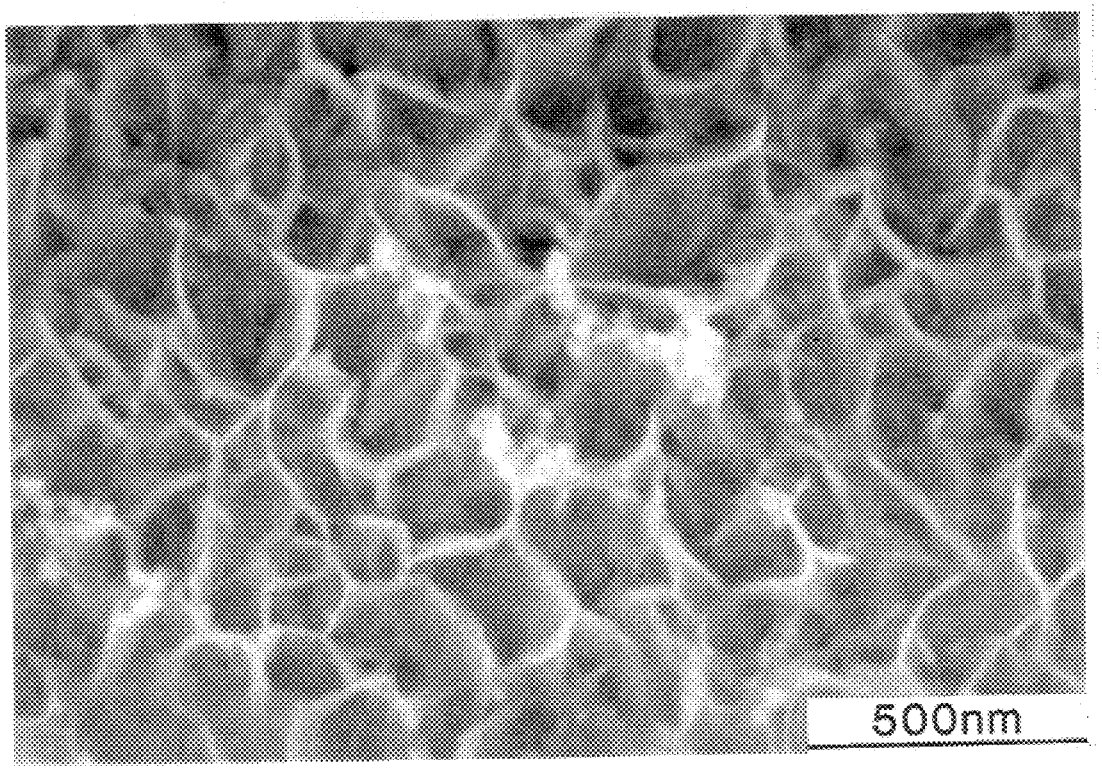
FIG. 1 is a photomicrograph of the rare earth impregnated aluminium oxide coating at the completion of step 6 of Example 3.

The process of the present invention includes the step of initiation of growth on the surface of the aluminium or aluminium alloy of an aluminium oxide, or hydrated aluminium oxide. The term "aluminium oxide" shall be herein used to refer to the compounds aluminium oxide, hydrated aluminium oxide or aluminium hydroxide either singly or in any combination thereof.

The surface of the metal is treated with a suitable solution in order to initiate aluminium oxide growth and to form a thin oxide layer on the metal surface. The thin oxide layer may be up to 10 nanometres thick.

Oxide growth is initiated by immersing the metal in an acidic solution containing an effective quantity of an oxidant. The acidic solution may be selected from one or more of nitric acid, phosphoric acid and sulphuric acid. Preferably, the acid is nitric acid. If present, the nitric acid preferably has a concentration of up to 1.6M.

Suitable oxidants include (metal) perchlorates, (metal) bromates, (metal) persulphates, nitrates, hydrogen peroxide and ammonium cerium (IV) nitrate. Preferably, the oxidant is $NaBrO_3$.

The solution may therefore contain nitric acid plus another acid. Nitric acid provides both an acidic and an oxidant function.

The preferred acidic oxidant-containing solution contains nitric acid and $NaBrO_3$.

Without wishing to limit the invention to a particular mechanism of oxidation, it is believed that part of the role of the acidic, oxidant containing solution is to react with and remove intermetallic particles from the metal surface.

If a halogen is present in the oxidant (such as in $NaBrO_3$) it may assist in removal of the oxide on the metal surface.

The oxidant may be present in solution up to its solubility limit. However, for most applications the oxidant is present at lower concentrations. A suitable maximum concentration is 10 wt %. The lower limit of oxidant concentration may be 0.01 wt %.

The pH of the acidic, oxidant-containing solution will vary according to the nature of the oxidant and the other species added to the solution. The pH of the acidic solution is preferably 5.5 or below, such as less than 5.0. In some embodiments, the pH is 4.5 and below and may be less than 4.0. In other embodiments of the invention, the pH is below 3.5. In a preferred embodiment, in the presence of $HNO_3$, the acidic solution has a pH of below 1.0.

A pH of less than 0.5 is preferred when the solution contains the oxidant $NaBrO_3$ and $HNO_3$. The low pH arises from use of $HNO_3$ in the $NaBrO_3$ solution. However other nitrates may partially or completely replace the $HNO_3$, resulting in variation of solution pH.

It is thought that a low pH may be required in order to dissolve oxide formed by the oxidant and thereby set up an equilibrium whereby only a thin oxide layer is formed. However, the exact reason for the need for a thin oxide layer to form is not known.

The temperature of the acidic, oxidant-containing solution may be any value up to the boiling point of the solution. The lower limit on solution temperature may be ambient temperature, such as from 10° C. to 30° C. In some embodiments of the invention, the temperature of the acidic solution is 20° C. Other embodiments of the process are conducted at a temperature higher than 20° C., such as up to 50° C. Alternatively, the solution temperature may be 25° C. or higher, and in some embodiments may be as high as 40° C.

The metal surface is treated with the acidic, oxidant-containing solution for a period of time sufficient to initiate growth of aluminium oxide on the metal surface to the desired degree. Treatment time may be up to one hour. However advantageously, it is 30 minutes or less, such as up to 20 minutes. In some embodiments, treatment with the acidic solution is conducted for up to 15 minutes and may be 10 minutes or less. In preferred embodiments, the treatment time is up to 7 minutes.

In one preferred embodiment, the acidic, oxidant containing solution comprises a 3% (0.2 molar) metal bromate solution containing 7% (1.1 molar) nitric acid having a pH less than 0.5. Treatment with the acidic solution is conducted at 25–40° C. for 7 minutes. It is followed by a rinse in water.

The process of the present invention further includes thickening the aluminium oxide layer by treatment with water. A continuous layer comprising a porous cellular structure is formed, typically a columnar structure. The treatment water is preferably distilled and/or deionised. However it may advantageously include particular additives. Preferably, the water has a low Si content, such as less than 0.05 ppm, or is Si free, because high Si content has been found to adversely affect oxide thickening. It is preferred that the pH of the treatment water is around neutral, such as from 4 to 7, since the dissolution rate of the oxide layer is minimal in this range. It is also preferred that the water has low halide concentrations or is halide free. Similarly, low or zero sulphate concentration is preferred. A surfactant may be included in the water, in an effective amount, in order to lower the surface tension of the solution. By lowering surface tension of the solution in the pores of the aluminium oxide layer as it is forming, the amount of cracking of the layer may be minimised. The surfactant may be cationic, anionic or non-ionic. Inclusion of a surfactant is further beneficial in that by reducing surface tension of the coating solution, it thereby minimises "drag-out" from the solution. "Drag-out" is an excess portion of coating solution which adheres to the metal and is removed from solution with the metal and subsequently lost. Accordingly, there is less waste and costs are minimised by adding surfactant to the coating solution.

The surfactant may be present in solution at a concentration up to 0.02 weight %, such as up to 0.015 weight %. Preferably, the concentration is around 0.01 weight % or lower. The lower limit on surfactant concentration may be around 0.001 weight %. However, in some embodiments, the lower concentration limit is 0.005 weight % whilst in others it is higher, such as 0.0075 weight %.

An example of a suitable surfactant is that available under the trade name FLUORAD "FC-135", which is a cationic fluorochemical surfactant. A water treatment solution containing FC-135 has a pH of around 5.5.

Other substances which may advantageously be added to the water used for oxide thickening include nitrate compounds such as potassium nitrate ($KNO_3$), cerium (III) sulphate octahydrate ($Ce_2(SO_4)_3.8H_2O$), solutions of ammonia and its salts, such as $NH_4OAc$, $NH_4NO_3$, $(NH_4)_2CO_3$, $NH_4OH$ and sodium carbonate $Na_2CO_3$.

The temperature of the water used for oxide thickening may be up to the boiling point of the treatment solution (that is, 100° C. for pure water), such as up to 95° C. Preferably, the temperature of treatment is up to 90° C. The lower limit of water temperature may be 70° C. In some embodiments of the invention, the temperature of the water treatment step is between 85 and 90° C. While the temperature of the water treatment solution may be less than 85° C., aluminium oxide growth is slower, and is even slower below 70° C.

The metal surface may be treated with the water for up to 60 minutes, such as up to 35 minutes. In some embodiments, the maximum treatment time is 20 minutes. The minimum treatment time may be as low as 2½ minutes. However, in some embodiments, the treatment time is greater than three minutes. Alternatively, the treatment time may be 5 minutes or more.

The present invention also includes the step of contacting the metal with rare earth elements in order to impregnate and substantially seal the oxide containing layer. The rare earth element is generally provided in the form of ions in an aqueous solution. The rare earth ion may possess more than one higher valence state. By "higher valence state" is meant a valence state above zero. If the rare earth ion does possess more than one higher valence state, the rare earth ion is added to the solution in a lower valence state. Such rare earth elements include cerium, praseodymium, neodymium, samarium, europium, terbium, thulium, lutetium and ytterbium. Preferably, the rare earth element is cerium and/or praseodymium and/or a mixture of rare earth elements.

The exact mechanism of sealing the oxide layer by treatment with rare earth elements is not known. However, while not intending to be limited to a particular mechanism of sealing, it is thought that the rare earth cation acts as a substitutional cation for $Al^{3+}$ in the aluminium oxide layer. Thus, when the rare earth element is cerium, it is preferably added as $Ce^{3+}$ which, it is believed, may substitute for $Al^{3+}$ in the oxide layer.

A rare earth solution may be made by dissolving a rare earth salt in water. Examples of suitable rare earth salts include $Ce(NO_3)_3.6H_2O$, $Ce_2(SO_4)_3.8H_2O$ and $Pr(NO_3)_3.6H_2O$. Preferably, the rare earth salt is cerium (III) nitrate hexahydrate ($Ce(NO_3)_3.6H_2O$).

A rare earth containing solution may contain up to 100 grams per liter (0.23 molar) of dissolved rare earth salt (expressed as equivalent grams of $Ce(NO_3)_3.-6H_2O$ per liter of solution) such as up to 50 grams per liter (0.12 molar). In some embodiments, the maximum concentration of rare earth salt is 40 grams/liter (0.092 molar). In other embodiments, the maximum concentration is 20 grams/liter (approximately 0.05 molar). Alternatively, the maximum concentration of rare earth salt may be 10 grams/liter (0.023 molar). The minimum amount of rare earth salt per liter of solution may be 0.1 grams ($2.3\times10^{-4}$ molar). However in some embodiments, the concentration is 0.5 g/l and above, such as above 1.0 g/l. In yet further embodiments, the minimum concentration is 5.0 grams/liter. These values of molarity of dissolved rare earth salt correspond to the molarities of the rare earth cation.

A rare earth containing solution may further include other additives. One such additive is excess nitrate ions, which may enhance oxidation of aluminium at the interface of the metal and the aluminium oxide phases. The excess nitrate ion may be added in various forms, including $KNO_3$, $LiNO_3$ or $NH_4NO_3$ or as combinations of these. The concentration of excess nitrate ion may be as high as the saturation limit of the corresponding nitrate salt. However lower concentrations of nitrate are also effective, such as up to 2.0M. A suitable concentration may be up to 1.0M.

Fluoride ions may also be added to the rare earth containing solution. They may be added as $MgF_2$ or NaF. If present, the $F^-$ ions may be present at a concentration of up to 0.01M, such as up to 0.005M. Preferably, the fluoride ions are present up to 0.001M. While the exact role of the $F^-$ ion is unknown, it is thought that $F^-$ attacks aluminium in the aluminium oxide layer to form a soluble $Al^{3+}$ complex. The Al in the oxide layer may then be replaced with the rare earth elements from the solution. The rare earth element may then be present in the oxide layer as an oxide or a fluoride or mixture thereof.

The temperature of treatment with the rare earth containing solution of the process may be as high as the boiling point of the solution, such as up to 95° C. Preferably, the maximum temperature is 90° C. The lower temperature limit may be 60° C. However, in some embodiments, the temperature of treatment with the solution is 70° C. and higher. Preferably, the temperature is 85° C. and above.

The rare earth containing solution preferably is acidic to neutral. It may have a pH up to 7, such as less than 5.5. In some embodiments of the process, the pH of the solution is less than 5. The pH may advantageously be above 4, such as 4.1 and above. Accordingly, for those embodiments of the invention, the preferred pH range is from 4 to 5. In further embodiments of the invention, the pH of the solution is 2 and above, such as higher than 3.

When $Ce(NO_3)_3.6H_2O$ is the rare earth salt used in the rare earth containing solution, it has been observed that the pH of the solution decreases slightly with increasing concentration of $Ce(NO_3)_3.6H_2O$.

The oxide coated metal surface is treated with the rare earth containing solution for a period of time sufficient to enable effective impregnation of the columnar aluminium oxide layer with the rare earth ions in solution. Treatment time may be up to 60 minutes. However normally treatment is for up to 40 minutes. Preferably, the treatment is carried out for a period of time up to 30 minutes. In some embodiments, effective impregnation is possible after treatment for 10 or more minutes, such as for at least 20 minutes.

Where the steps of water treatment and rare earth element treatment occur sequentially, the majority of the thickness of the columnar aluminium oxide layer is produced during the water treatment step. However, there may be additional thickening of this layer during the step of treatment with rare earth elements.

In one embodiment of the invention, the treatment of the metal with water and with rare earth elements is effected simultaneously by treating the metal with an aqueous solution containing rare earth ions. Hence the aqueous component of the rare earth solution provides the water required to thicken the oxide on the metal surface and form an oxide layer of the desired thickness and the rare earth ions impregnate the oxide layer. In this embodiment, oxide layer thickening and impregnation with rare earth elements occurs substantially simultaneously.

Figure 2:
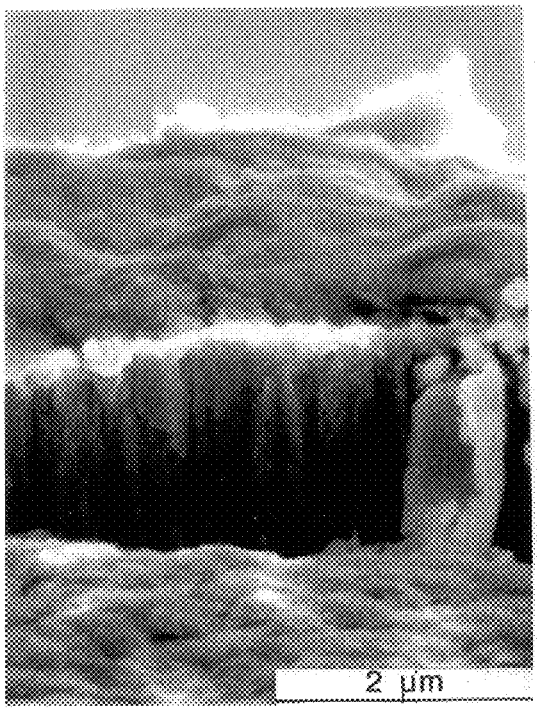
FIG. 2 is another photomicrograph of the rare earth impregnated aluminium oxide coating at the completion of step 6 of Example 3.

At the completion of the process of the invention, the impregnated oxide coating on the metal surface preferably has a porous, crazed oxide structure. An embodiment of such a structure is shown in FIG. 1, relating to Example 3. FIG. 2 shows that this coating has a thickness of approximately 1.51 $\mu$m and has a columnar structure.

The sealing step, if present, may comprise treatment of the rare earth impregnated coating with an aqueous or non-aqueous inorganic, organic or mixed inorganic/organic sealing solution. A preferred sealing solution is an inorganic sealing solution. Preferably the sealing solution contains one or more oxidants. In one preferred embodiment, the sealing solution comprises a silicate solution, such as an alkali metal silicate solution.

In addition to the sealing solution forming a surface layer on the rare earth impregnated oxide layer, it penetrates and fills the pores of the crazed oxide structure.

Figure 4:
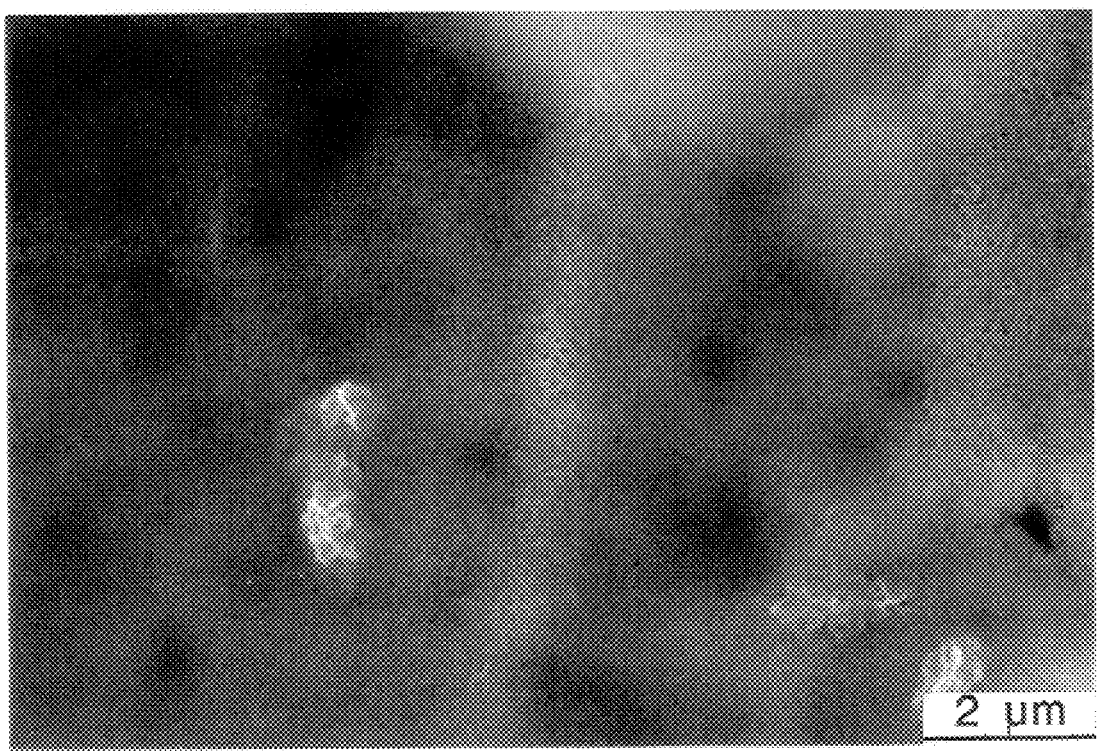
FIGS. 4 & 5 are photomicrographs of the silicate-sealed coating of Example 3 at the completion of step 7.
Figure 5:
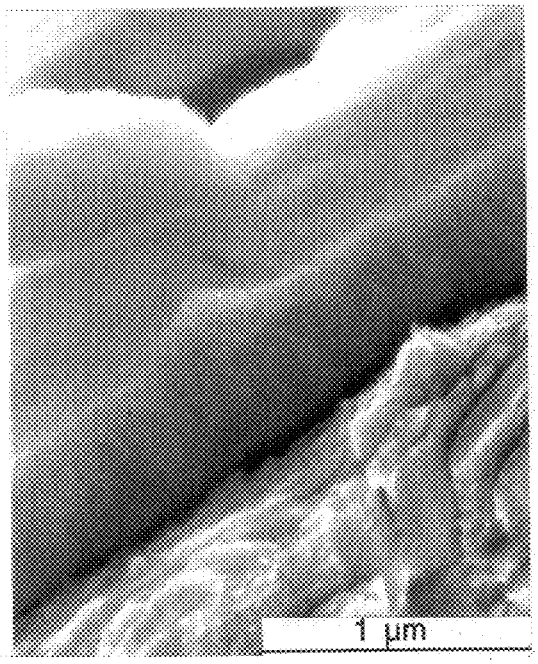
Figure 3:
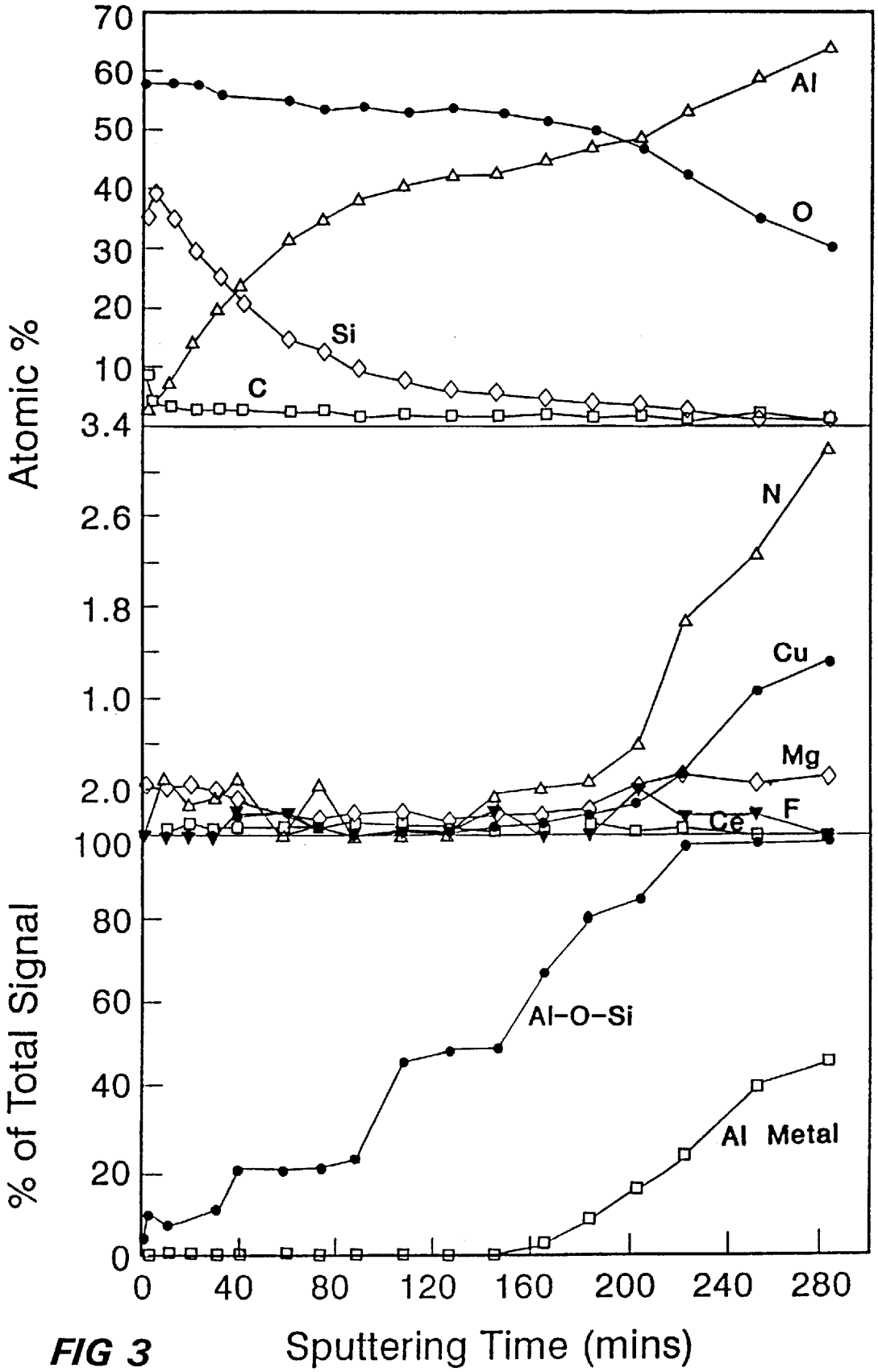
FIG. 3 is an X-ray photoelectron spectroscopy depth profile of the silicate-sealed coating of Example 3, at the completion of step 7.

An X-ray photoelectron spectroscopy depth profile of the sealed, rare earth impregnated oxide coating of Example 3 is given in FIG. 3. In the embodiment, after sealing with a silicate solution, the thickness of the coating was less and the structure of the coating had altered from a crazed oxide structure to a smooth surfaced coating with a thickness of less than 1 $\mu$m. FIGS. 4 and 5 illustrate these features. Furthermore, the sealed coating has a layered structure comprising a homogeneous, smooth outer layer disposed on the columnar structure of the impregnated aluminium oxide. The depth profile for this embodiment shown in FIG. 3 suggests that the outer layer comprises predominantly a silicate phase and the inner, columnar layer, comprises predominantly an aluminosilicate phase.

The concentration of the alkali metal silicate may be below 20%, such as below 15%. A preferred upper limit of alkali metal silicate concentration is 3.6% [10%] (approximately 0.012M $K_2O$ and 0.04M $SiO_2$.) The lower concentration limit of the alkali metal silicate may be 0.001%, such as 0.01%. A preferred lower limit of concentration is 0.018% (approx. $2.1\times10^{-5}$M $K_20/7.4\times10^{-5}$M $SiO_2$.)

The temperature of the sealing solution may be as high as 100° C., such as up to 95° C. Preferably the temperature is up to 90° C. and is more preferably below 85° C. A suitable temperature is up to 70° C. The lower limit of the temperature is preferably ambient temperature, such as from 10° C. to 30° C.

The aluminium oxide coating is treated with the sealing solution for a period of time sufficient to produce the desired degree of sealing. A suitable time period may be up to 30 minutes, such as up to 15 minutes. Preferably the treatment lasts for up to 10 minutes. The minimum period of time may be 2 minutes.

EXAMPLES

The following Examples illustrate, in detail, embodiments of the invention. In all of the Examples, the metal substrate used was a panel of 2024 aluminium alloy having the dimensions 3 inches by 1 inch (7.6 cm by 2.5 cm), with the exception of Examples 1, 2 and 58 to 61 in which the panels were 3 inches by 4 inches (7.6 cm by 10.2 cm). The 2024 aluminium alloy is part of the 2000 series alloys, which is one of the most difficult to protect against corrosion, particularly in a chloride ion containing environment. Such environments exist, for example, in sea water, or exposure to sea spray and around airport runways and roads, where salt may be applied.

In the Examples, corrosion resistance is measured by the amount of time it takes for the metal to develop pitting in neutral salt spray (NSS), according to the American standard salt spray tests described in American Society for Testing of Materials (ASTM) Standard B-117. Time to pitting of 20 hours represents a considerable improvement in the corrosion resistance of 2024 alloy and can be considered as an acceptable indicator for some applications. In other applications, 48 hours in neutral salt spray is normally required, whereas for aerospace applications, 168 hours is normally required.

Corrosion resistance is also measured by "TAFEL" values. The TAFEL experiment is an electrochemical method of measuring the rate of corrosion of a coated or uncoated metal. The coated metal is placed in a cell containing 0.5M NaCl together with a saturated KCI calomel reference electrode and a platinum counter electrode. The potential of the coated surface is controlled relative to the reference electrode by a potentiostat which also measures the current. The corrosion rate is calculated from the intercepts of the linear sections of a plot of potential against $\log_{10}$ (current) (a "Tafel" plot), at the corrosion potential. By measuring Tafel plots over a prolonged period of exposure, an indication of the variation of corrosion rate with time may be obtained. The TAFEL data for each Example includes the time in hours ("h") after preparation of the coating when $i_{corr}$ was measured.

A disadvantage of some prior conversion coating processes, as previously stated, is the long coating times that are required to put down the coating. In some cases, a period of between several hours and several days is required. One advantage of the present process is the relatively short coating times, such as under one hour in most embodiments.

All conversion coatings described in the Examples were found to have good paint adhesion properties when subsequently tested according to ASTM D-2794. The paint adhesion properties were similar to or better than the properties of alloys coated with chromate conversion coatings. Further, at least the preferred embodiments of the conversion coatings passed adhesion tests such as the scribe tests described in ASTM D-3330 and Boeing Specification Support Standard (BSS) 7225. Moreover, the conversion coatings of the invention often out performed chromate coatings of the prior art in "Impact Resistance Testing", as described in Boeing Material Specification (BMS) 10-11R.

In the following Examples, reference is made to potassium silicate sealing solution PQ Kasil #1 and PQ Kasil #2236. PQ Kasil #2236 ($SiO_2/K_2O$–3.49) is slightly more alkaline than PQ Kasil #1 ($SiO_2/K_2O$=3.92) and has a lower ratio of $SiO_2/K_2O$.

Examples 1 to 5

A sample of 2024 aluminium alloy was wiped with acetone then conversion coated according to the following process:

Step 1: a preliminary degrease in BRULIN for 10 minutes at a temperature of 60 to 70° C.

Step 2: (Examples 1 and 2 only) alkaline clean in RIDOLINE 53 at 60 to 70° C. for 5 minutes.

Step 3: deoxidise and desmut the metal surface using the deoxidising solutions and conditions given in Table I.

Step 4: immerse cleaned metal in a 0.2M $NaBrO_3$ solution in the presence of 1.1M $HNO_3$ and having a pH of less than 0.5 for 7 minutes at 20° C. to initiate growth of aluminium oxide on surface of metal.

Step 5: immerse in deionised water for 5 minutes at a temperature of 85 to 90° C. to form a thickened, porous oxide layer with a crazed structure. (In Examples 3, 4 and 5, the water includes 0.01 wt % of surfactant FC-135).

Step 6: immerse plate in a cerium solution containing 10 g/liter (0.023M) of $Ce(NO_3)_3.6H_2O$, and having a pH between 4 and 5, for 30 minutes at a temperature of 85 to 90° C. in order to impregnate the porous oxide layer with Ce ions.

Step 7: For Examples 1, 2 and 4, immerse coated sample in a potassium silicate sealing solution comprising PQ Kasil #1 at a concentration of 2.91 wt % (0.19M) and having a pH between 10.5 to 11, at 20° C. for 2 minutes. For Example 3, immerse coated plate in PQ Kasil #2236 solution having a concentration of 1.8% (0.006M $K_20$/0.02M $SiO_2$) at 20° C. for 4 minutes and allow to dry before the final rinse. This step results in a reduction in the overall thickness of the coating and a smooth surfaced coating.

There was a 5 minute rinse in water between all the above steps.

The final coated metal alloy had a two layered coating comprising an outer, relatively smooth homogeneous layer and an inner, columnar structure layer.

Table I shows the deoxidising solution used in step 3 for Examples 1 to 4 and the resulting performance in neutral salt spray, expressed as "NSS"—which is the time to pifting of the coated alloy in neutral salt spray. It should be noted that step 5 of Examples 3, 4 and 5 differs from the other Examples in that the water contains 0.01 wt % of the surfactant FC-135.

TABLE I

DEOXIDISING SOLUTIONS

| Ex. | Deoxidising Solution Used in Step 3 | T(° C.) (and time) of Step 3 | NSS (hours) | TAFEL $i_{corr}$ ($\mu A \cdot (cm^{-2})$) |
|---|---|---|---|---|
| 1 | Amchem #4 (Chromate-based deoxidising solution) | RT* (10 min) | 50 | |
| 2 | Turco WO#1 (phosphate based deoxidising solution) | RT* (5 min) | 25 | |
| 3 | 0.03M $Ce(SO_4)_2$ and 0.8 molar $H_2SO_4$ (prepared from cerium (IV) hydroxide) | RT* (5 min) | 168 | 20 h 0.09<br>140 h 0.05 |
| 4 | 0.02 molar $Pr_2(SO_4)_3$ and 0.7 molar $H_2SO_4$. (prepared from praseodymium oxide) | RT* (5 min) | 70 | 1 h 0.06<br>50 h 0.02 |
| 5 | 35 grams/liter (0.06 molar of ammonium cerium (IV) sulphate in 5.5 wt % (0.5 molar) $H_2SO_4$ solution | RT* (5 min) | 70 | 20 h 0.01<br>90 h 0.03 |

*RT = room temperature (20–25° C.)

Thus, the corrosion resistance of Example 3 far exceeded those of the other Examples. Accordingly, it appears that a cerium based deoxidising solution used in step 3, results in a high corrosion resistance of the subsequently applied conversion coating.

FIGS. 1 and 2 illustrate the impregnated oxide coating of Example 3 prior to treatment with the silicate sealing solution. FIGS. 3 to 5 relate to Example 3 after the silicate seal step.

Moreover, the coated alloy of Example 3 passed adhesion tests described in ASTM D-3330 and Boeing Specification Support Standard 7225 as well as forward and reverse impact resistance testing in Boeing Material Specification 10-11R.

Examples 6 and 7

Variations of the temperature of treatment with the deoxidising solution are shown in Table II. All steps are the same as for Example 3, except that the treatment temperature of the rare earth deoxidising solution of step 3 is varied.

TABLE II

| TEMPERATURE OF DEOXIDISING SOLUTION | | | |
|---|---|---|---|
| Example | T(° C.) | NSS (hours) | TAFEL $i_{corr}$ ($\mu A \cdot cm^{-2}$) |
| 6 | 20 | 168 | 20 h 0.005<br>100 h 0.05 |
| 7 | 50 | 60 | 0 h 0.02<br>50 h 0.007 |

It is evident that, for the particular conditions of Examples 6 and 7, an increase in temperature of the $Ce(SO_4)_2$ deoxidising solution in step 3 results in a decrease in corrosion resistance.

Example 6 passed adhesion tests described in ASTM D-3330 and Boeing Specification Support Standard (BSS) 7225 and impact resistance tests described in Boeing Material Specification (BMS) 10-11R.

Examples 8 and 9

The temperature of treatment with the deoxidising solution in step 3 of Example 5 was varied according to Table III.

TABLE III

| TEMPERATURE OF DEOXIDISING SOLUTION | | | |
|---|---|---|---|
| Example | T(° C.) | NSS (hours) | TAFEL $i_{corr}$ ($\mu A \cdot cm^{-2}$) |
| 8 | 20 | 70 | 20 h 0.01<br>90 h 0.03 |
| 9 | 40 | 100 | |

Converse to the trend observed in Examples 6 and 7, Examples 8 and 9 indicate that, for the conditions specified, an increase in temperature of the ammonium cerium (IV) sulphate deoxidising solution results in an increase in corrosion resistance.

Examples 10 and 11

The steps of deoxidising the metal surface and of treating with an acidic solution containing $NaBrO_3$ for initiation of oxide growth may be combined into a single step. Accordingly, Examples 10 and 11 involve the following steps:

Step 1: degrease in BRULIN at 60 to 70° C. for 10 minutes.

Step 2: treat with a solution comprising 1.5 wt % (0.1 molar) $NaBrO_3$, 3.4 wt % (0.5 molar) $HNO_3$, 0.5 wt % (0.015 molar) $Ce(SO_4)_2$ and 3.5 wt % (0.4 molar) $H_2SO_4$ for 5 minutes at the temperatures given in Table IV.

Step 3: immerse alloy in deionised/distilled water containing 0.01% surfactant FC-135 for 5 minutes at a temperature of 85 to 90° C. to form a thickened, porous oxide layer with a crazed structure.

Step 4: immerse alloy in a cerium solution containing 10 g/liter of $Ce(NO_3)_3.6H_2O$ for 30 minutes at a temperature of 85 to 90° C. in order to impregnate the porous oxide layer with Ce ions.

Step 5: immerse coated plate in a potassium silicate sealing solution comprising PQ Kasil #2236 at a concentration of 1.8 wt %, at room temperature for 2 minutes. This results in a reduction in the overall thickness of the coating and a smooth surfaced coating.

TABLE IV

| TEMPERATURE OF $Ce(SO_4)_2/NaBrO_3$ SOLUTION | | | |
|---|---|---|---|
| Example | T(° C.) | NSS (hours) | TAFEL $i_{corr}$ ($\mu A \cdot cm^{-2}$) |
| 10 | 20 | 168 | 0 h 0.04<br>120 h 0.07 |
| 11 | 40 | 168 | 0 h 0.03<br>120 h 0.10 |

Examples 10 and 11 show that, for the particular conditions specified, an increase in temperature of a combined deoxidising/oxide growth initiation solution does not affect corrosion performance.

Examples 12 to 15

A 2024 aluminium alloy plate was cleaned, then conversion coated according to the following process:

Step 1: vapour degrease the 2024 alloy plate in trichloroethane vapour for 15 minutes.

Step 2: dip in a 35 wt % (5.5 molar) $HNO_3$/0.96 wt % (0.48 molar) HF acid solution at room temperature for 1 minute.

Step 3: alkaline clean in 2.5 wt % (0.6 molar) NaOH solution at 35 to 40° C.

Step 4: dip in a 35 wt % (5.5 molar) $HNO_3$/0.96 wt % (0.48 molar) HF acid solution at room temperature for 1 minute.

Step 5: treat with $NaBrO_3$ solution, with additional $HNO_3$, under the conditions given in Table V for 7 minutes.

Step 6: immerse in water at a temperature of 85 to 90° C. for 5 minutes.

Step 7: immerse in an aqueous solution of $Ce(NO_3)_3.6H_2O$ at 10 grams/liter (0.023 molar) at a temperature of 85 to 90° C. for 30 minutes.

Step 8: seal in a potassium silicate solution, PQ Kasil #1 at a concentration of 2.91% (0.19M), at room temperature for 2 minutes.

All the above steps have a 5 minute rinse in water after them.

TABLE V

| CONDITIONS OF TREATMENT WITH $NaBrO_3$ SOLUTION IN STEP 5 | | | | |
|---|---|---|---|---|
| Ex. | T(° C.) | $HNO_3$ Concentration | NSS (hours) | TAFEL $i_{corr}$ ($\mu A \cdot cm^{-2}$) |
| 12 | 20 | 7%(1.1M) | 40 | 70 h 0.02<br>140 h 0.03 |
| 13 | 50 | 7% (1.1M) | 20 | 0 h 0.20<br>50 h 0.05 |
| 14 | 20 | 21%(3.3M) | 100 | 0 h 0.02<br>50 h 0.06 |
| 15 | 20 | 42% (6.7 M) | 20 | 0 h 1.75<br>50 h 0.50 |

Examples 12 to 15 illustrate that there is some improvement in corrosion resistance by increasing the $HNO_3$ concentration to 21% in the oxide growth initiation step. However, at concentrations of $HNO_3$ between 21% and 42%, there is a decrease in corrosion resistance. Moreover, Examples 12 and 13 indicate that in the presence of low $HNO_3$ concentrations, an increase in temperature of the $NaBrO_3$ containing solution results in a decrease in corrosion resistance.

Examples 16, 17

The steps of Examples 12 to 15 are varied by omitting step 4 and replacing step 5 with the step of immersing the plate in 0.1M ammonium ceric nitrate ($(NH_4)_2Ce(NO_3)_6$) solution with an addition of 1.1% (0.17 molar) $HNO_3$, for the times listed in Table VI.

TABLE VI

TREATMENT TIME WITH $(NH_4)_2Ce(NO_3)_6$ AND $HNO_3$ SOLUTION

| Example | Time (mins.) | NSS (hours) | TAFEL $i_{corr}$ ($\mu A \cdot cm^{-2}$) |
|---|---|---|---|
| 16 | 1 | 30 | 0 h 0.20<br>100 h 0.20<br>120 h 0.04 |
| 17 | 7 | 40 | 90 h 0.04<br>120 h 0.05 |

These Examples show that an increase in treatment time with the $(NH_4)_2Ce(NO_3)_6$ solution results in an improved corrosion resistance.

Examples 18 and 19

Step 6 of Examples 12–15 was varied in Examples 18 and 19 by immersing the plate in $H_2O$ at 85 to 90° C. for the times listed in Table VII. All other steps are the same as for 12–15, with the exception that in step 5, $NaBrO_3$ was at 50° C. and contains 7% (1.1M) $HNO_3$.

TABLE VII

TIME OF TREATMENT WITH $H_2O$

| Example | Time (mins.) | NSS (hours) | TAFEL $i_{corr}$ ($\mu A \cdot cm^{-2}$) |
|---|---|---|---|
| 18 | 2.5 | 40 | 0 h 0.08<br>20 h 0.02<br>50 h 0.02 |
| 19 | 5 | 40 | |

A comparison of Examples 18 and 19 shows that, for these particular conditions, an increase in treatment time with the water and surfactant solution of step 5 results in little effect on corrosion resistance.

Examples 20 to 22

Step 6 of Example 13 was varied by immersing the alloy in $H_2O$ with potassium nitrate added at the concentrations given in Table VIII at 85 to 90° C. for 5 minutes. All other steps are the same as for Example 13.

TABLE VIII

CONCENTRATION OF $KNO_3$

| Example | $KNO_3$ Concentration (molar) | NSS (hours) | TAFEL $i_{corr}$ ($\mu A \cdot cm^{-2}$) |
|---|---|---|---|
| 20 | 0.05 | 20 | 20 h 0.01<br>230 h 1.80 |
| 21 | 0.5 | 20 | 20 h 0.50<br>230 h 0.30 |
| 22 | 1.0 | 10 | 0 h 0.40<br>40 h 0.07 |

Examples 20 to 22 demonstrate that, for the particular conditions of these Examples, $KNO_3$ may be added to the water treatment of step 6 without adversely affecting corrosion performance. However Example 22 indicates that at a concentration of $KNO_3$ above 0.5 molar, corrosion resistance declines. This value is different however where other parameters of the process have been varied, for instance, when $Ce(NO_3)_3.6H_2O$ concentration in step 7 is varied—see Examples 42 to 44.

Examples 23 and 24

Examples 23 and 24 contain the same steps as for Examples 20 to 22, with the exception that, instead of $KNO_3$, surfactant is added to the water in step 6. The surfactant is a fluorochemical surfactant commercially available under the trade name FLUORAD FC135. The concentration of FC135 and corrosion performance data are provided in Table IX.

TABLE IX

CONCENTRATION OF FC-135

| Example | FC-135 Concentration | NSS (hours) | TAFEL $i_{corr}$ ($\mu A \cdot cm^{-2}$) |
|---|---|---|---|
| 23 | 0.001% | 25 | 1 h 0.10<br>20 h 0.08 |
| 24 | 0.02% | 30 | 20 h 0.09<br>70 h 0.10<br>160 h 0.20 |

Examples 23 and 24 show that under the specific set of conditions for each Example, increasing the concentration of surfactant in the water of step 6, makes no significant improvement to corrosion performance.

Example 25

In Example 25, instead of $KNO_3$, cerium (III) sulphate octahydrate ($Ce_2(SO_4)_3.8H_2O$) is added to the water of step 6 in a concentration of 20 grams/liter (0.028 molar) with all other steps the same as for Examples 20 to 22.

TABLE X

ADDITION OF $Ce_2(SO_4)_3.8H_2O$

| Example | $Ce_2(SO_4)_3.8H_2O$ Concentration | NSS (hours) | TAFEL $i_{corr}$ ($\mu A \cdot cm^{-2}$) |
|---|---|---|---|
| 25 | 20 grams/liter (0.028 molar) | 20 | 0 h 0.30<br>20 h 0.05<br>70 h 0.60 |

Under the particular conditions of this Example when compared with Examples 20 and 21, there was no apparent change in corrosion performance when $KNO_3$ was substituted with $Ce_2(SO_4)_3.8H_2O$ in step 6.

Examples 26 to 31

The steps of Example 3 were varied by replacing the water of step 5 with a solution according to the details of Table XI. All other steps are the same as for Example 3 with the exception that surfactant is not added in step 5, unless specified in Table XI.

TABLE XI

SOLUTION COMPOSITION IN STEP 4

| Example | Solution | NSS (hours) | TAFEL $i_{corr}$ ($\mu A \cdot cm^{-2}$) |
|---|---|---|---|
| 26 | 0.1% (0.01M) $NH_4OAc$ | 10 | 0 h 0.30<br>80 h 0.03 |
| 27 | 0.1% (0.01M) $NH_4OAc$ + 0.01% FC-135 | 20 | 0 h 0.40<br>70 h 0.02 |
| 28 | 0.001M $NH_4OH$ | 168 | 0 h 0.05<br>30 h 0.05 |
| 29 | 0.001M $NH_4NO_3$ | 45 | 20 h 0.02<br>140 h 0.04 |
| 30 | 0.001M $(NH_4)_2CO_3$ | 85 | 20 h 0.10<br>140 h 0.02 |
| 31 | 0.001M $Na_2CO_3$ | 40 | 20 h 0.04<br>100 h 0.04 |

The results show that replacement of the water and surfactant solution of step 5 of Example 3 with the solutions defined in Examples 26, 27, 29, 30 and 31 does not produce as good a corrosion resistant coating as Example 3, but still produces markedly better resistance than the bare metal, under the particular conditions of those Examples. However, when different concentrations of those other solutions are used, different corrosion resistances may result. Example 28 indicates similar corrosion resistance as compared to Example 3, when the water/surfactant solution is replaced with a 0.001M $NH_4OH$ solution.

Examples 32 to 38

The concentration of $Ce(NO_3)_3.6H_2O$ in step 7 was varied according to the values in Table XII. All other steps are the same as for Examples 20 to 22, except that no $KNO_3$ is added to the water in step 6.

TABLE XII $Ce(NO_3)_3 6H_2O$ CONCENTRATION

| Ex. | $Ce(NO_3)_3.6H_2O$ (g/l) | $Ce(NO_3)_3.6H_2O$ (molar) | pH | NSS (hrs) | TAFEL $i_{corr}$ ($\mu A \cdot cm^{-2}$) |
|---|---|---|---|---|---|
| 32 | 0.1 | $2.3 \times 10^{-4}$ | 5.05 | 40 | 20 h 0.008<br>90 h 0.10 |
| 33 | 0.5 | $1.15 \times 10^{-3}$ | 4.90 | 60 | 0 h 0.03<br>90 h 0.08 |
| 34 | 1.0 | $2.3 \times 10^{-3}$ | 4.75 | 20 | 0 h 0.03<br>90 h 0.20 |
| 35 | 5.0 | 0.012 | 4.55 | 50 | 0 h 0.07<br>20 h 0.03<br>120 h 0.10 |
| 36 | 10.0 | 0.023 | 4.45 | 80 | 0 h 0.06<br>20 h 0.04<br>100 h 0.04 |
| 37 | 20.0 | 0.046 | 4.00 | 50 | 0 h 0.50<br>20 h 0.10<br>120 h 0.40 |
| 38 | 40.0 | 0.092 | 3.75 | 50 | 0 h 0.40<br>120 h 0.03 |

Examples 32 to 38 show that with increasing $Ce(NO_3)_3.6H_2O$ concentration, there is a general increase in corrosion resistance for the particular conditions of these Examples. It should be noted that the pH varies from 5.05 to 3.75. However, it appears that the maximum cost benefit is achieved when the concentration of $Ce(NO_3)_3.6H_2O$ is between 10 g/l and 20 g/l. However, there could be cost benefit in higher concentration when other parameters of the process are varied.

Examples 39 to 41

Excess nitrate was added to the $Ce(NO_3)_3.6H_2O$ solution according to the following process.

Step 1: vapour degrease the 2024 aluminium alloy plate in trichloroethane vapour for 15 minutes.

Step 2: treat in $NaBrO_3$ solution for 7 minutes at 50° C.

Step 3: immerse in $H_2O$ at a temperature of 85 to 90° C. for 5 minutes.

Step 4: immerse in $Ce(NO_3)_3.6H_2O$ solution at a concentration of 10 grams/liter (0.023 molar) having 1.0M excess nitrate as detailed in Table XIII, at a temperature of 85 to 90° C. for 30 minutes.

Step 5: seal in a potassium silicate solution, PQ Kasil #1 at a concentration of 2.91% (0.19M) having 0.001% anionic fluorochemical surfactant FC-99 added, at room temperature for 2 minutes.

The plate is rinsed in water for 5 minutes after each step.

TABLE XIII

ADDITION OF EXCESS NITRATE

| Ex. | Nitrate Species (1.0M) | pH | NSS (hours) | TAFEL $i_{corr}$ ($\mu A \cdot cm^{-2}$) |
|---|---|---|---|---|
| 39 | $KNO_3$ | 4.5–5.0 | 50 | 0 h 0.04<br>50 h 0.01<br>70 h 0.01 |
| 40 | $LiNO_3$ | 4.40 | 40 | 20 h 0.05<br>50 h 0.03<br>70 h 0.02<br>90 h 0.03 |
| 41 | $NH_4NO_3$ | 3.75 | 30 | 20 h 0.02<br>40 h 0.02<br>70 h 0.01<br>140 h 0.02 |

Examples 39 to 41 illustrate, for the particular conditions of those Examples, an overall increase in corrosion resistance in going from $NH_4NO_3$ to $LiNO_3$ to $KNO_3$ addition to the rare earth sealing solution. It should be noted that there is a corresponding increase in pH of the rare earth sealing solution.

Examples 42 to 44

Excess nitrate can be added to the $Ce(NO_3)_3.6H_2O$ bath at a concentration of cerium lower than that in Examples 20 to 22. All steps in Examples 42 to 44 are the same as for Examples 20 to 22, except that in step 6, the solution does not contain $KNO_3$ and in step 7, the solution contains 1M $KNO_3$ and the cerium concentrations provided in Table XIV.

TABLE XIV $Ce(NO_3)_3.6H_2O$ CONCENTRATION

| Ex. | $Ce(NO_3)_3.6H_2O$ (grams/liter) | $Ce(NO_3)_3.6H_2O$ (molar) | pH | NSS (hours) | TAFEL $i_{corr}$ ($\mu A \cdot cm^{-2}$) |
|---|---|---|---|---|---|
| 42 | 0.1 | $2.3 \times 10^{-4}$ | 5.30 | 60 | 0 h 0.02<br>70 h 0.04<br>120 h 0.02 |
| 43 | 0.5 | $1.15 \times 10^{-3}$ | 5.15 | 60 | 20 h 0.03<br>90 h 0.02 |

TABLE XIV-continued

| Ce(NO$_3$)$_3$.6H$_2$O CONCENTRATION | | | | | |
|---|---|---|---|---|---|
| | Ce(NO$_3$)$_3$.6H$_2$O | | | NSS | TAFEL |
| Ex. | (grams/liter) | (molar) | pH | (hours) | $i_{corr}$ ($\mu A \cdot cm^{-2}$) |
| 44 | 1.0 | $2.3 \times 10^{-3}$ | 5.05 | 40 | 20 h 0.20<br>90 h 0.05 |

Examples 42 to 44 show that for the particular conditions of Examples 42 to 44, corrosion performance starts to decline at a concentration of Ce(NO$_3$)$_3$.6H$_2$O between 0.5 and 1.0 g/l.

Example 45

The steps in Example 45 are the same as those for Example 39, except that in step 4, cationic fluorochemical surfactant FC-135 (Fluorad) 0.005 wt % is added to the Ce(NO$_3$)$_3$.6H$_2$O solution in the presence of 1M KNO$_3$ and in step 5 the silicate solution was heated to 50° C. with immersion for 2 minutes. The approximate pH of the Ce(NO$_3$)$_3$.6H$_2$O solution was 4.75. Accordingly, the change in conditions between Example 39 and Example 45 do not adversely affect corrosion performance.

| Example | NSS (hours) | TAFEL $i_{corr}$ ($\mu A \cdot cm^{-2}$) |
|---|---|---|
| 45 | 50 | 0 h 0.70<br>20 h 0.04<br>50 h 0.03<br>70 h 0.04 |

Example 46

Step 7 of Example 13 was modified by replacing Ce(NO$_3$)$_3$.6H$_2$O with Ce$_2$(SO$_4$)$_3$.8H$_2$O at a concentration of 20 grams/liter (0.028 molar). The pH of the rare earth sealing solution was 3.15. All other steps were the same as for Example 13. Accordingly, the change in conditions between Example 13 and Example 46 do not result in an adverse change in corrosion performance.

| Example | NSS (hours) | TAFEL $i_{corr}$ ($\mu A \cdot cm^{-2}$) |
|---|---|---|
| 46 | 20 | 20 h 0.07<br>70 h 0.04<br>170 h 0.07 |

Examples 47 and 48

Step 7 of Example 13 was again modified by adding fluoride ions to the Ce(NO$_3$)$_3$.6H$_2$O bath at the concentrations provided in Table XV, and immersing the plate in the bath for only 15 minutes. All other steps were the same as for Example 13.

TABLE XV

| FLUORIDE ADDITION TO Ce(NO$_3$)$_3$.6H$_2$O SOLUTION | | | | | |
|---|---|---|---|---|---|
| Ex. | Fluoride Species | pH | Concentration (Molar) | NSS (hrs) | TAFEL $i_{corr}$ ($\mu A \cdot cm^{-2}$) |
| 47 | MgF$_2$ | 4.10 | 0.001 | 5 | 0 h 0.10<br>100 h 0.02<br>120 h 0.06 |
| 48 | NaF | 4.25 | 0.002 | 15 | |

For these specific conditions, addition of the fluoride species to the rare earth sealing solution appears to adversely affect corrosion resistance.

Examples 49 and 50

In step 6 of Example 3, Ce(NO$_3$)$_3$.6H$_2$O was replaced with Pr(NO$_3$)$_3$.6H$_2$O at a concentration of 10 grams/liter (0.02 molar). All other steps were the same as for Example 3, except that in Example 50, step 3 comprised pretreatment with a praseodymium containing solution, as for step 3 of Example 4.

TABLE XVI

| Pr(NO$_3$)$_3$.6H$_2$O SUBSTITUTED FOR Ce(NO$_3$)$_3$.6H$_2$O IN STEP 6 | | | | | |
|---|---|---|---|---|---|
| Ex. | Pretreatment Solution | Pr(NO$_3$)$_3$.6H$_2$O Concentration (grams/liter) | (molar) | NSS (hrs) | TAFEL $i_{corr}$ ($\mu A.cm^{-2}$) |
| 49 | Cerium | 10 | 0.02 | 60 | 0h 0.05<br>120h 0.06 |
| 50 | Praseodymium | 10 | 0.02 | 30 | 2h 0.07<br>90h 0.04 |

These Examples show that, for the specified conditions, pretreatment with a cerium containing deoxidising solution resulted in better corrosion performance than pretreatment with a praseodymium containing deoxidising solution. Moreover, comparison of Example 49 with Example 3 indicates that better corrosion performance results when the cerium containing solution is used in step 6 than when a praseodymium containing solution is used. However, different results may be achieved when other parameters of the process are varied.

Examples 51 to 53

Examples 51 to 53 illustrate varying concentration of silicate in the potassium silicate sealing solution.

Steps 1 to 6 are the same as for the corresponding steps of Example 1, with the exception that in step 3, the deoxidising solution is a rare earth pretreatment solution as described in step 3 of Example 3 and in step 5, the water bath includes 0.01% of the surfactant FC-135.

Step 7 comprises sealing with a potassium silicate solution, PQ Kasil #2236 at room temperature for 4 minutes and at the concentrations given in Table XVII.

TABLE XVII

SILICATE CONCENTRATIONS

| Ex. | Silicate Concentration wt % | pH | NSS (hrs.) | TAFEL $i_{corr}$ ($\mu A.cm^{-2}$) |
|---|---|---|---|---|
| 51 | 1.8 | 10.9 | 220 | 0h 0.04<br>110h 0.08 |
| 52 | 3.6 | 11 | 200 | 20h 0.02<br>110h 0.01 |
| 53 | 5.4 | 11 | 60 | 20h 0.006<br>110h 0.01 |

Examples 51 to 53 clearly illustrate improved corrosion resistance at silicate concentrations below around 3.6 wt %. For the specific conditions of these Examples, corrosion resistance noticeably decreases between 3.6 and 5.4 wt % of silicate in the silicate sealing solution. This range of silicate concentration may therefore be the maximum cost beneficial silicate concentration. However, there could be cost benefit in higher silicate concentration when other parameters of the process are varied.

Examples 54 to 56

Examples 54 to 56 illustrate varying the temperature of the silicate sealing solution.

Step 1: vapour degrease 2024 alloy in trichloroethane for 15 minutes.

Step 2: treat with a solution of 10 g/l (0.023 molar) $Ce(NO_3)_3.6H_2O$ and 1M $KNO_3$ for 30 minutes at 85 to 90° C.

Step 3: seal in 2.91% potassium silicate PQ Kasil #1 for 2 minutes at the temperatures described in Table XVIII.

TABLE XVIII

TEMPERATURE OF SILICATE SOLUTION

| Example | T (° C.) | NSS (hours) | TAFEL $i_{corr}$ ($\mu A.cm^{-2}$) |
|---|---|---|---|
| 54 | 30 | 50 | 0h 0.40<br>20h 0.10<br>100h 0.06 |
| 55 | 50 | 50 | 0h 0.30<br>20h 0.09<br>100h 0.03 |
| 56 | 75 | 50 | 0h 0.40<br>20h 0.08<br>100h 0.04 |

Examples 54 to 56 show that for the particular conditions of those Examples, variation in the temperature of the silicate sealing solution did not affect the corrosion performance.

Example 57

Instead of potassium silicate, the sealing solution may include sodium silicate.

Steps 1 to 4 are the same as for Example 39.

Step 5 comprises sealing in sodium silicate solution at 36 grams/liter (0.3 molar) at 50° C. having a pH of approximately 11 for 10 minutes. There was a 5 minute rinse in water between all steps.

Comparison of Example 57 with Example 39 shows that, for the particular conditions of these Examples, substitution of potassium silicate solution with sodium silicate solution resulted in a slight decrease in corrosion resistance. However, the result may be different where other variables are varied.

TABLE XIX

SODIUM SILICATE SEALING SOLUTION

| Example | NSS (hours) | TAFEL $i_{corr}$ ($\mu A.cm^{-2}$) |
|---|---|---|
| 57 | 40 | 20h 0.04<br>40h 0.02<br>70h 0.01<br>140h 0.02<br>160h 0.008 |

Examples 58 to 61

Other types of sealing solutions are exemplified by Examples 58 to 61.

Step 1: aqueous degrease 2024 alloy in Brulin at 60 to 70° C. for 10 minutes.

Step 2: immerse in 35 wt % (7.9 molar) $HNO_3$/0.96wt % (0.48 molar) HF acid solution for one minute at ambient temperature.

Step 3: alkaline clean in 2.5% (0.6 molar) NaOH solution at room temperature.

Step 4: treat in $NaBrO_3$ solution for 7 minutes at room temperature.

Step 5: immerse in $H_2O$ at 85 to 90° C for 5 minutes.

Step 6: immerse in $Ce(NO_3)_3.6H_2O$ solution having a concentration of 10 grams/liter (0.023 molar) at a temperature of 85 to 90° C. for 30 minutes.

Step 7: treat with the sealing solutions described in Table XX.

There is a 5 minute rinse after each step.

TABLE XX

SEALING SOLUTIONS

| Ex. | Sealing Solution | pH | NSS (hrs) | TAFEL $i_{corr}$ ($\mu A.cm^{-2}$) |
|---|---|---|---|---|
| 58 | $(CH_3COO)_2Ni.4H_2O$ (24 g/l; 0.10 molar), $MnSO_4$ (12 g/l; 0.08-molar), $NH_4NO_3$ (30 g/l;-) 0.38 molar) | 5.55 | 30 | 0h 0.01<br>30h 0.07 |
| 59 | $H_3BO_3$ (13.2 g/L;-0.21 molar), $COSO_4 \cdot 7H_2O$ (6.6 g/l;-0.02 molar), $CH_3COONH_4$ (6.6 g/l;-0.09 molar) | 6.15 | 30 | 0h 0.02<br>30h 0.40 |
| 60 | $CoSO_4.7H_2O$ (6.6 g/l;-0.02 molar), $NH_4VO_3$ (1.3 g/l;-0.01 molar), $H_3BO_3$ (13.2 g/l;-0.21 molar) | 5.55 | 80 | 0h 0.01<br>30h 0.01 |
| 61 | $H_3BO_3$ (7.9 g/l;-0.13 molar), $Na_2B_4O_7$ (7.9 g/l;-0.02 molar), $NaNO_2$ (7.9 g/l; 0.11-molar), $NH_4VO_3$ (1.3 g/l;-0.01 molar) | approx 8 | 30 | 0h 0.02<br>20h 0.03 |

All sealing solutions gave acceptable corrosion resistance. However, under the specific conditions of Examples 58 to 61, the sealing solution defined in Example 60 gave the best corrosion resistance.

Examples 62 to 64

Variation in the type of oxidant used to initiate aluminium oxide growth is illustrated by the following Examples.

Step 1: alkaline clean the 2024 alloy in Brulin at 60 to 70° C. for 10 minutes.

Step 2: deoxidise in a rare earth pretreatment solution prepared from cerium (IV) hydroxide and contains 0.03 molar $Ce(SO_4)_2$ and 0.8 molar $H_2SO_4$. The 2024 is immersed in the rare earth pretreatment solution for 5 minutes at 20° C.

Step 3: immersion in solution containing oxidant in the presence of 7% (1.1M) $HNO_3$ listed in Table XXI below for 7 mins at 20° C.

Step 4: immersion in $H_2O$ containing 0.01% surfactant FC-135 at 85–90° C. for 5 minutes.

Step 5: immersion in $Ce(NO_3)3.6H_2O$ at a concentration of 10 g/L (0.023 molar) at 85–90° C. for 30 minutes and Step 6: sealed in a 1.8% potassium silicate (PQ Kasil #2236) solution at room temperature for 4 minutes.

All steps involve a 5 minute rinse between them.

TABLE XXI

OXIDANT TYPES

| Example | Oxidant Type | Oxidant Concentration (molar) | pH | NSS (hrs) (Approx) |
|---|---|---|---|---|
| 62 | $NaBrO_3$ | 0.2 | <1 | 100 |
| 63 | $KBrO_3$ | 0.2 | <1 | 90 |
| 64 | $KClO_3$ | 0.15 | <1 | 90 |

Examples 62 to 64 indicate that, at least for the specific conditions of these Examples, use of $NaBrO_3$ to initiate oxide growth results in better corrosion resistance than use of either $KBrO_3$ or $KClO_3$. However, a different result may be achieved when other variables are varied.

Examples 65 and 66

The temperature of the rare earth deoxidising solution was varied according to Examples 65 and 66.

Step 1: alkaline clean the 2024 alloy plate in Brulin at 60 to 70° C. for 10 minutes.

Step 2: deoxidise in a rare earth pretreatment solution containing 0.1M $Ce(SO_4)_2$ and 2M $H_2SO_4$. The 2024 is immersed in the rare earth pretreatment solution for five minutes at the temperatures shown in Table XXII.

Step 3: immersion in $NaBrO_3$ solution for 7 minutes at 20° C.

Step 4: immersion in $H_2O$ containing 0.01% surfactant FC-135 at 85–90° C. for 5 minutes.

Step 5: immersion in a $Ce(NO_3)_3.6H_2O$ solution at a concentration of 10 g/L (0.023 molar) at 85–90° C. for 30 minutes and Step 6: sealed in a 1.8% potassium silicate PQ Kasil #2236 solution at room temperature for 4 minutes.

All steps involve a 5 minute rinse between them.

TABLE XXII

TEMPERATURE OF DEOXIDISING SOLUTION

| Example | Temp (° C.) | NSS (hrs) |
|---|---|---|
| 65 | 20 | 100 |
| 66 | 40 | 100 |

Examples 65 and 66 show that for the conditions specified in these two Examples, variation of the temperature of the deoxidising solution does not affect the corrosion resistance.

Finally, it is to be understood that, although the invention has been described with particular reference to the foregoing Examples and accompanying drawings, it will be clear that various modifications and improvements may be made without departing from the spirit and scope thereof.

We claim:

1. A process for forming a chromate and phosphate free conversion coating on the surface of a metal, including the steps:

(a) contacting the metal surface with a deoxidizing solution in order to remove smut from the metal surface;

(b) contacting the metal with an acid solution containing an oxidant selected from the group consisting of: metal halate, metal persulphate, nitrate, $H_2O_2$ or $(NH_4)_2Ce(NO_3)_6$ and having a pH of less than 1, in order to initiate growth of a metal oxide cell structure on the metal surface, said acidic, oxidant-containing solution having a composition different to said deoxidizing solution;

(c) contacting the metal surface with water having a temperature between 70° C. and the boiling point, for a period of time sufficient to thicken the oxide structure and form a metal oxide containing layer of a desired thickness; and (d) contacting the metal surface with an aqueous, rare earth element containing solution in order to impregnate and substantially seal the metal oxide containing layer.

2. The process of claim 1, wherein said metal is aluminum or an aluminum containing alloy.

3. The process of claim 2, wherein said metal halate is selected from $NaBrO_3$, $KBrO_3$ and $KClO_3$.

4. The process of claim 3, wherein said metal halate is $NaBrO_3$.

5. The process of claim 1, wherein said acidic solution contains $HNO_3$.

6. The process of claim 5, wherein the concentration of said $HNO_3$ is up to 1.6 molar.

7. The process of claim 1, wherein the concentration of said oxidant in said acidic solution is up to 10 wt %.

8. The process of claim 1, wherein the concentration of said oxidant in said acidic solution is up to 0.2M.

9. The process of claim 1, wherein the pH of said acidic solution in step (b) is less than 1.

10. The process of claim 1, wherein the pH of said acidic solution is less than 0.5.

11. The process of claim 1, wherein the temperature of said acidic solution is 50° C. or lower.

12. The process of claim 1, wherein the temperature of said acidic solution is in ambient temperature range of 10° C. to 30° C.

13. The process of claim 1, wherein said deoxidizing solution contains one or more rare earth ions.

14. The process of claim 13, wherein said deoxidizing solution comprises cerium (IV) hydroxide, cerium (IV)

sulphate or ammonium cerium (IV) sulphate dissolved in a mineral acid solution.

15. The process of claim 13, wherein said deoxidizing solution comprises cerium (IV) sulphate dissolved in a sulphuric acid and nitric acid solution.

16. The process of claim 1, wherein the step of treatment with a deoxidizing solution precedes the step of contacting the metal with said acidic solution.

17. The process of claim 1, wherein the step of deoxidizing the metal surface occurs simultaneously with the step of contacting the metal with said acidic solution by contacting said metal surface with a single solution comprising a combination of the acidic oxidant-containing solution and the deoxidizing solution.

18. The process of claim 1, wherein the step of contacting the metal with water comprises contact with deionized and/or distilled water.

19. The process of claim 1, wherein the temperature of said water is from 85 to 90° C.

20. The process of claim 1, wherein said water includes a surfactant.

21. The process of claim 1, wherein said water further includes one or more additives selected from nitrate compounds, solutions of ammonia and its salts, and sodium carbonate.

22. The process of claim 21, wherein said one or more additives includes $NH_4OH$.

23. The process of claim 1, wherein said rare earth element is provided by aqueous rare earth ion containing solution comprising a rare earth salt selected from $Ce(NO_3)_3 6H_2O$, $Ce_2(SO_4)_3 8H_2O$ and $Pr(NO_3)_3 6H_2O$ dissolved in water.

24. The process of claim 23, wherein the oxide thickening step and the rare earth element impregnation step occur substantially simultaneously by treating the metal with an aqueous, rare earth ion containing solution in which the aqueous component provides the water required for thickening the metal oxide layer and the rare earth ions impregnate the metal oxide.

25. The process of claim 23, wherein said rare earth salt comprises $Ce(NO_3)_3 6H_2O$.

26. The process of claim 23, wherein the concentration of said rare earth salt in the aqueous, rare earth ion containing solution is up to 50 grams/liter.

27. The process of claim 23, wherein the concentration of said rare earth salt in the aqueous, rare earth element containing solution is from 0.1 grams/liter to 40 grams/liter.

28. The process of claim 23, wherein the pH of the aqueous, rare earth ion containing solution is acidic to neutral.

29. The process of claim 23, wherein the pH of the aqueous, rare earth ion containing solution is from 3 to 5.5.

30. The process of claim 23, wherein the pH of the aqueous, rare earth ion containing solution is from 4 to 5.

31. The process of claim 23, wherein the temperature of the aqueous, rare earth ion containing solution is between 70° C. and 100° C.

32. The process of claim 23, wherein the temperature of the aqueous, rare earth ion containing solution is between 85° C. and 100° C.

33. The process of claim 23, wherein the temperature of the aqueous, rare earth ion containing solution is between 85° C. and 90° C.

34. The process of claim 23, wherein the aqueous, rare earth ion containing solution further includes one or more components selected from nitrate ions, fluoride ions and surfactants.

35. The process of claim 23, wherein the aqueous, rare earth element containing solution includes additional nitrate ions added as $KNO_3$, $LiNO_3$ or $NH_4NO_3$ or as a combination thereof.

36. The process of claim 34, wherein the concentration of nitrate ions is 2.0 molar or lower.

37. The process of claim 1, further including the step of contacting the metal with a sealing solution to form a surface layer over the rare earth impregnated oxide layer.

38. The process of claim 37, wherein said sealing solution is an inorganic sealing solution.

39. The process of claim 37, wherein said sealing solution includes an oxidant.

40. The process of claim 37, wherein said sealing solution is an alkali metal based solution.

41. The process of claim 40, wherein said sealing solution is a potassium silicate solution.

42. The process of claim 1, wherein each step is followed by a water rinsing step.

43. A conversion coated metal formed by a process of claim 1, wherein the conversion coating comprises a metal oxide containing layer which is impregnated with one or more rare earth elements.

44. The conversion coated metal of claim 43, wherein said metal is an aluminum containing metal.

45. The conversion coated metal of claim 43, wherein said metal oxide is aluminum oxide, hydrated aluminum oxide or aluminum hydroxide, either singly or in any combination thereof.

* * * * *